US006227005B1

(12) United States Patent
Higginbotham et al.

(10) Patent No.: US 6,227,005 B1
(45) Date of Patent: May 8, 2001

(54) PROCESS FOR THE PRODUCTION OF OXYGEN AND NITROGEN

(75) Inventors: Paul Higginbotham, Guildford (GB); Rakesh Agrawal, Emmaus; Donn Michael Herron, Fogelsville, both of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/517,067

(22) Filed: Mar. 1, 2000

(51) Int. Cl.[7] ..... F25J 3/00

(52) U.S. Cl. ..... 62/646; 62/654

(58) Field of Search ..... 62/646, 654, 940

(56) References Cited

U.S. PATENT DOCUMENTS

| | | | | |
|---|---|---|---|---|
| 4,254,629 | | 3/1981 | Olszewski | 62/13 |
| 4,433,989 | | 2/1984 | Erickson | 62/13 |
| 5,511,381 | * | 4/1996 | Higginbotham | 62/646 |
| 5,675,977 | * | 10/1997 | Prosser | 62/652 |
| 5,678,426 | | 10/1997 | Agrawal et al. | 62/647 |
| 5,682,764 | | 11/1997 | Agrawal et al. | 62/646 |
| 5,682,765 | * | 11/1997 | Lynch et al. | 62/646 |
| 5,765,396 | * | 6/1998 | Bonaquist | 62/646 |

* cited by examiner

*Primary Examiner*—Ronald Capossela
(74) *Attorney, Agent, or Firm*—Willard Jones, II

(57) ABSTRACT

A process for the production of oxygen and nitrogen is applicable when the oxygen product is withdrawn from a distillation column system as a liquid, pumped to an elevated pressure and warmed at least in part by cooling a suitably pressurized stream. At least a portion of the compressed, purified, and cooled air is introduced to a first of at least three distillation columns. The first distillation column contains at least a condenser at its top, produces at least an oxygen-lean stream from or near its top and a first oxygen-enriched liquid from its bottom. A second distillation column, which contains a reboiler in its bottom, has no condenser, receives at least a portion of nitrogen-enriched liquid as a feed to its top, and produces a first nitrogen-rich vapor stream from its top and a second oxygen-enriched liquid from its bottom. A third distillation column, which contains a reboiler in its bottom, has no condenser, receives at least a portion of nitrogen-enriched liquid as a feed to its top, receives at least said second oxygen-enriched liquid as a feed, and produces a second nitrogen-rich vapor from its top and a liquid oxygen-rich stream from its bottom. The liquid oxygen-rich stream from said third distillation column is elevated in pressure and warmed, at least in part, by indirect heat exchange with a pressurized stream having a nitrogen content greater than or equal to that in the feed air, said pressurized stream being cooled without being subjected to distillation. The second distillation column receives as a feed at least one of (a) a portion of said first oxygen-enriched stream from said first distillation column; or (b) a portion of said cooled pressurized stream. The third distillation column receives as a feed at least one of (a) a portion of said first oxygen-enriched stream from said first distillation column; or (b) a portion of said cooled pressurized stream. In the preferred mode of operation, the first distillation column is at the highest pressure, the third distillation column is at the lowest pressure, and the second distillation column is at an intermediate pressure.

17 Claims, 9 Drawing Sheets

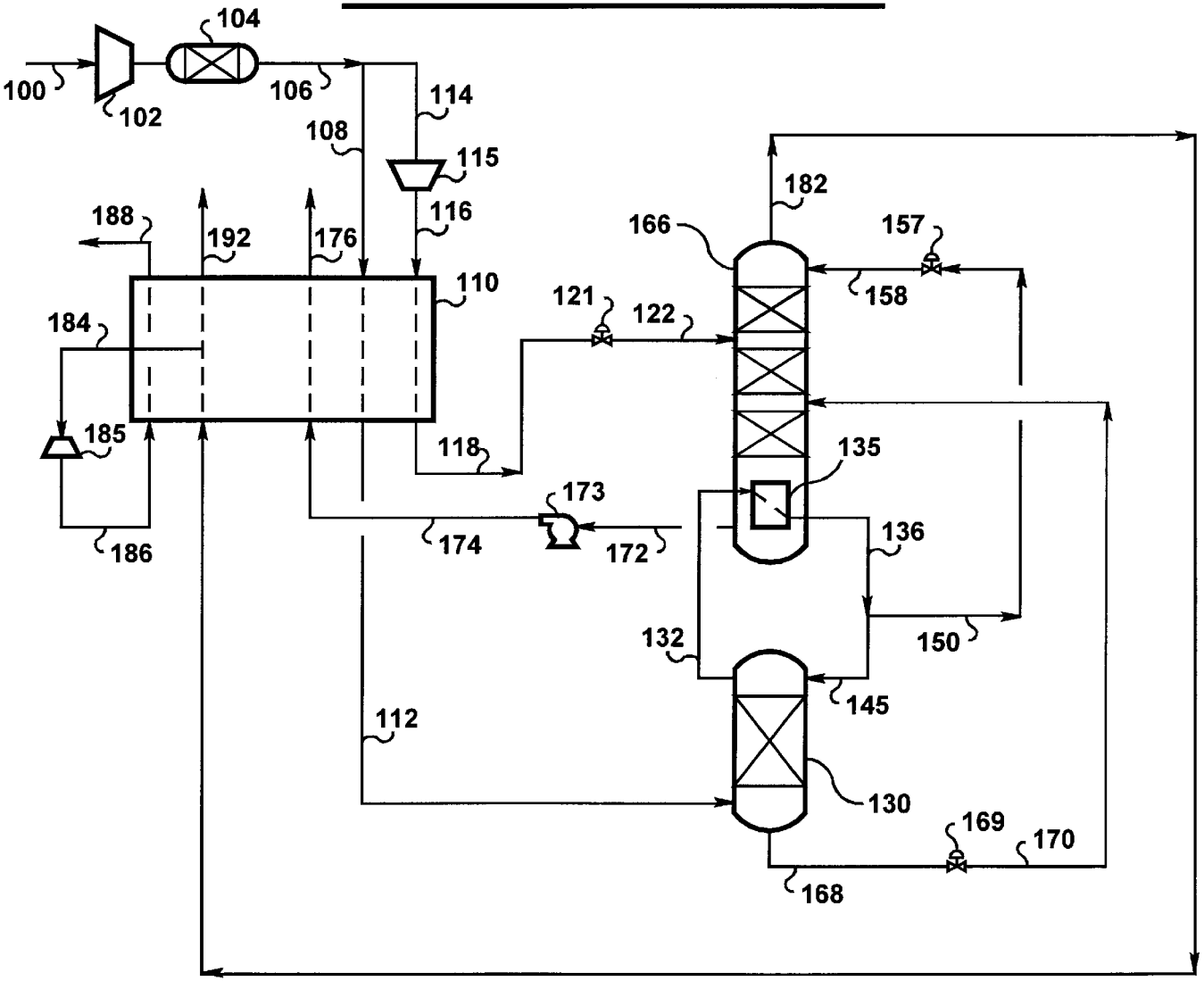
FIGURE 9 - PRIOR ART

PROCESS FOR THE PRODUCTION OF OXYGEN AND NITROGEN

CROSS-REFERENCE TO RELATED APPLICATIONS

Not Applicable.

STATEMENT REGARDING FEDERALLY SPONSORED RESEARCH FOR DEVELOPMENT

Not Applicable.

BACKGROUND OF THE INVENTION

The present invention relates generally to the production of oxygen and nitrogen from a cryogenic air separation plant, and more particularly to the production of pressurized oxygen using pumped-LOX (liquid oxygen) and the production of at least a portion of nitrogen as pressurized nitrogen.

The most well known cryogenic process for the production of both oxygen and nitrogen is the double-column cycle. This process uses a distillation column system comprising a higher pressure column, a lower pressure column and a reboiler-condenser which thermally links the two columns. Early versions of the double-column cycle produced both nitrogen and oxygen as vapors from the lower pressure column. Recently, it has become commonplace to withdraw the oxygen product from the distillation column system as a liquid, raise the pressure of the liquid oxygen by using either static head or a pump, and warm it in a main heat exchanger by cooling some suitably pressurized stream. This method of oxygen delivery is referred to as pumped-LOX. When large quantities of pressurized nitrogen are also required it is typical to elevate the pressure of the lower pressure column to recover nitrogen at some pressure greater than atmospheric.

Processes of this type are often called elevated pressure, or EP, cycles. Numerous examples of elevated pressure, double column, pumped-LOX cycles exist in the open literature. An example of one such prior art cycle is shown in FIG. 9.

A commercial application for such a process is the production of low purity oxygen (less than 98 mole % oxygen) and nitrogen for Coal Gasification Combined Cycle (CGCC) power and chemical plants. Since an objective of such applications is to produce power, it is essential that the air separation process be energy efficient. The need for high efficiency has given rise to many modifications to the conventional elevated pressure, double-column, pumped-LOX cycle.

One solution for improving the efficiency of the double-column cycle is to utilize a third distillation column as in U.S. Pat. No. 5,682,764 (Agrawal, et al.). This patent teaches the use of a third column which operates at a pressure intermediate that of the higher and lower pressure columns. This third column receives a vapor air feed which is at a lower pressure than the main air feed to the higher pressure column. This intermediate pressure column has a condenser but no reboiler, and produces liquid nitrogen reflux for the lower pressure column. Power consumption is reduced by only having to compress a fraction of the feed air to the pressure of the higher pressure column.

Another patent which teaches the use of a third column to improve efficiency is U.S. Pat. No. 5,678,426 (Agrawal, et al.). This patent also teaches the use of a third column which operates at a pressure intermediate that of the higher and lower pressure columns. This third column receives oxygen-enriched liquid from the bottom of the higher pressure column as a feed. This intermediate pressure column contains both a reboiler and a condenser, and produces a nitrogen-rich stream from its top and a further-oxygen-enriched liquid from its bottom.

Another patent which teaches the use of a third column to improve efficiency is disclosed in U.S. Pat. No. 4,254,629 (Olszewski). Olszewski teaches the use of a third intermediate pressure column which functions much like that of U.S. Pat. No. 5,682,764. Olszewski also discloses a four-column version which has a pair of double columns in parallel. As taught by Olszewski, both lower pressure columns operate at essentially the same pressure. One higher pressure column operates at a lower pressure than the other. This is achieved by maintaining the composition in the bottom of one lower pressure column more oxygen-lean than the other - - the higher pressure column which is thermally linked to the lower pressure column having the more oxygen-depleted composition can thereby operate at lower pressure. Olszewski also teaches to pass oxygen-depleted vapor to the other lower pressure column.

None of the three patents discussed above teaches modes of operation using pumped-LOX.

U.S. Pat. No. 4,433,989 (Erickson) also teaches the use of a third column to improve efficiency. Erickson teaches the use of a third intermediate pressure column in conjunction with a double-column process. The steps taught by Erickson include: 1) passing all the air to the higher pressure column; 2) passing essentially all the oxygen-enriched liquid from the higher pressure column into the intermediate pressure column; 3) distilling in the intermediate pressure column to produce a nitrogen-rich vapor and a further oxygen enriched liquid; 4) passing the further oxygen-enriched liquid to the lower pressure column; 5) refluxing both intermediate pressure column and lower pressure column with nitrogen-enriched liquid from the higher pressure column; and 6) providing boilup to both the intermediate pressure column and the lower pressure column by indirect heat exchange with condensing vapor from the higher pressure column Erickson also suggests an operating method using pumped-LOX. Erickson teaches that pressurized air is passed to the bottom of a fourth distillation column. This distillation column produces a nitrogen-rich liquid from its top and an oxygen-enriched liquid from its bottom—much like a typical higher pressure column would. The condenser for this fourth column is operated by vaporizing the oxygen product at elevated pressure.

It is desired to have an efficient process for separating air to produce oxygen and nitrogen, wherein the oxygen is produced as a pressurized product and at least a portion of the nitrogen is produced as a pressurized product.

It also is desired to have an efficient mode of utilizing pumped-LOX in a multi-column cycle comprising three or more distillation columns.

BRIEF SUMMARY OF THE INVENTION

The present invention is a process for separating air to produce oxygen and nitrogen using a distillation column system having at least three distillation columns. The invention also includes a cryogenic air separation unit using the process.

One embodiment of the invention is a process for separating air to produce oxygen and nitrogen using a distillation column system having at least three distillation columns.

The system includes a first distillation column, a second distillation column, and a third distillation column, each distillation column having a top and a bottom. The process comprises multiple steps. The first step is to provide a stream of compressed air having a first nitrogen content. The second step is to feed at least a first portion of the stream of compressed air to the first distillation column. The third step is to withdraw a first oxygen-enriched stream from the bottom of the first distillation column and to feed at least a portion of the first oxygen-enriched liquid stream to the second distillation column and/or the third distillation column. The fourth step is to withdraw a first oxygen-lean vapor stream from or near the top of the first distillation column, to feed at least a first portion of the first oxygen-lean vapor stream to a first reboiler-condenser of the second distillation column or of the third distillation column, and to at least partially condense the at least a first portion of the first oxygen-lean vapor stream, thereby forming a first nitrogen-enriched liquid. The fifth step is to feed at least a first portion of the first nitrogen-enriched liquid to the top of the first distillation column. The sixth step is to feed a second nitrogen-enriched liquid and/or at least a second portion of the first nitrogen-enriched liquid to the top of the second distillation column. The seventh step is to withdraw a second oxygen-enriched liquid stream from the bottom of the second distillation column and to feed the second oxygen-enriched liquid stream to the third distillation column. The eighth step is to withdraw a first nitrogen-rich vapor stream from the top of the second distillation column. The ninth step is to withdraw a second nitrogen-rich vapor stream from the top of the third distillation column. The tenth step is to withdraw a liquid oxygen stream from the bottom of the third distillation column, wherein said liquid oxygen stream is elevated in pressure before being warmed at least in part by indirect heat exchange with a pressurized stream having a nitrogen content at least equal to the first nitrogen-content, said pressurized stream being cooled without being subjected to distillation. The eleventh step is to feed at least a portion of the cooled pressurized stream eventually to any or all of the first distillation column, the second distillation column, or the third distillation column.

There are variations of this embodiment. For example, in one variation, the pressurized stream is the first portion of the stream of compressed air. In another variation, the pressurized stream is another portion of the stream of compressed air. In a variant of that variation, the process includes an additional step. The additional step is to compress further the another portion of the stream of compressed air.

There are still other variations of this embodiment. For example, in one variation the pressurized stream is a compressed portion of an oxygen-lean vapor stream withdrawn from the distillation column system. In another variation, the first distillation column is at a first pressure, the second distillation column is at a second pressure lower than the first pressure, and the third distillation column is at a third pressure lower than the second pressure. In yet another variation, a boilup for the second distillation column is provided at least in part by indirect heat exchange with the first portion of the oxygen-lean vapor and a boilup for the third distillation column is provided at least in part by indirect heat exchange with another portion of the first oxygen-lean vapor.

Another embodiment of the invention has the same multiple steps as the embodiment discussed above, but includes five additional steps. The first additional step is to provide a fourth distillation column having a top and a bottom. The second additional step is to feed a second portion of the first oxygen-lean vapor stream from the first distillation column to the bottom of the fourth distillation column. The third additional step is to withdraw a third nitrogen-enriched liquid stream from the bottom of the fourth distillation column and to feed at least a portion of the third nitrogen-enriched liquid to the second distillation column and/or the third distillation column. The fourth additional step is to withdraw a second oxygen-lean vapor stream from or near the top of the fourth distillation column, to feed at least a first portion of the second oxygen-lean vapor stream to a second reboiler-condenser of the second distillation column or of the third distillation column, to at least partially condense the first portion of the second oxygen-lean vapor stream, thereby forming a fourth nitrogen-enriched liquid, and to feed at least a portion of the fourth nitrogen-enriched liquid to the top of the fourth distillation column. The fifth additional step is to withdraw a high purity nitrogen stream from the second oxygen-lean vapor stream or the fourth nitrogen-enriched liquid.

In a variation of this embodiment, a boilup for the second distillation column is provided at least in part by indirect heat exchange with the first portion of the first oxygen-lean vapor stream, and a boilup for the third distillation column is provided at least in part by indirect heat exchange with the first portion of the second oxygen-lean vapor stream.

There is yet another embodiment of the present invention. This embodiment has the same multiple steps as the first embodiment, but includes five additional steps. The first additional step is to provide a fourth distillation column having a top and a bottom. The second additional step is to feed another portion of the stream of compressed air to the bottom of the fourth distillation column. The third additional step is to withdraw a third oxygen-enriched liquid stream from the bottom of the fourth distillation column, and to feed at least a portion of the fourth oxygen-enriched liquid stream to the second distillation column and/or the third distillation column. The fourth step is to withdraw a second oxygen-lean vapor stream from or near the top of the fourth distillation column, to feed at least a portion of the second oxygen-lean vapor stream to a second reboiler-condenser of the second distillation column or of the third distillation column, and to at least partially condense the second oxygen-lean vapor stream, thereby forming the second nitrogen-enriched liquid. The fifth step is to feed at least a portion of the second nitrogen-enriched liquid to the top of the fourth distillation column.

There are several variations of this embodiment. For example, in one variation, the fourth distillation column is at a fourth pressure greater than a first pressure of the first distillation column. In another variation, the fourth distillation column is at a fourth pressure less than a first pressure of the first distillation column. In yet another variation, a boilup for the third distillation column is provided at least in part by indirect heat exchange with the first portion of the first oxygen-lean vapor stream, and a boilup for the second distillation column is provided at least in part by indirect heat exchange with the second oxygen-lean vapor stream.

There is still yet another embodiment of the present invention. This embodiment has the same multiple steps as the first embodiment, but includes three additional steps. The first additional step is to withdraw a vapor stream from the first distillation column at an intermediate location, to feed the vapor stream to a second reboiler-condenser of the second distillation column or of the third distillation column, and to at least partially condense the vapor stream, thereby forming an intermediate reflux stream. The second additional step is to feed the intermediate reflux stream to the first distillation column at or near the intermediate location. The third additional step is to withdraw the second nitrogen-enriched liquid from the first distillation column at or near the intermediate location for feeding at least a portion to the top of the second distillation column or the third distillation column.

There are several variations of this embodiment. In one variation, the boilup for the second distillation column is provided at least in part by indirect heat exchange with the vapor stream withdrawn at the intermediate location, and a boilup for the third distillation column is provided at least in part by indirect heat exchange with the first portion of the first oxygen-lean vapor stream. In another variation, a boilup for the third distillation column is provided at least in part by indirect heat exchange with the vapor stream withdrawn at the intermediate location, and a boilup for the second distillation column is provided at least in part by indirect heat exchange with the first portion of the first oxygen-lean vapor stream.

Another aspect of the present invention is a cryogenic air separation unit using a process as in any of the embodiments or variations thereof discussed above.

BRIEF DESCRIPTION OF THE DRAWINGS

The invention is best understood from the following detailed description when read in connection with the accompanying drawings, in which.

and

Figure 1:
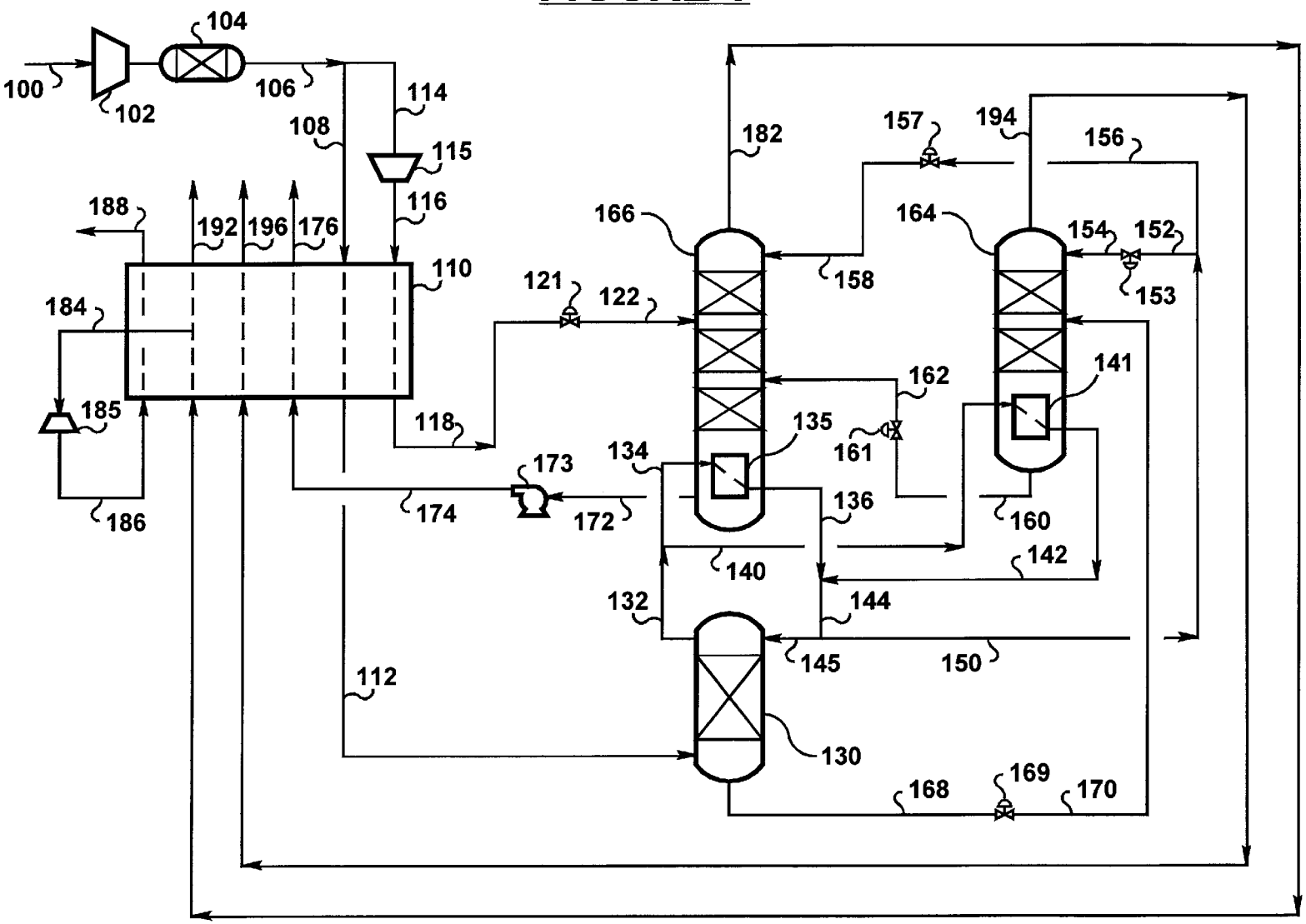
FIG. 1 is a schematic diagram of a first embodiment of the present invention.

FIG. 9 is a schematic diagram of a conventional elevated pressure, double-column, pumped-LOX process.

DETAILED DESCRIPTION OF THE INVENTION

The present invention is a process for the production of oxygen and nitrogen using a distillation column system. The process is applicable when the oxygen product is withdrawn from the distillation column system as a liquid, pumped to an elevated pressure, and warmed at least in part by cooling a suitably pressurized stream. In the preferred mode of operation, nitrogen product is produced at a pressure greater than 20 psia and the purity of the oxygen product is less than 98 mole % (low purity oxygen). In the most preferred mode of operation, the nitrogen product is produced at a pressure greater than 30 psia and the ratio of nitrogen production to oxygen production is greater than 1.5 mole/mole.

The term "oxygen-rich" is understood to represent the oxygen product and corresponds to an oxygen content less than 99.9 mole %, preferably greater than 85 mole % and, preferably less than 98 mole %. It also is understood that the term "nitrogen-rich" represents nitrogen product and corresponds to a nitrogen content greater than 95 mole %, preferably greater than 98 mole %.

The term "oxygen-enriched" is understood to mean having an oxygen concentration greater than that of air. The term "nitrogen-enriched" is understood to mean having a nitrogen concentration greater than that of air. (The concentration of a "nitrogen-enriched" stream is typically similar to that of a "nitrogen-rich" stream.)

The term "oxygen-lean" means having an oxygen concentration less than that of air. An "oxygen-lean" stream could have a composition similar to a "nitrogen-enriched" stream, but it could contain much less oxygen than a nitrogen-enriched or nitrogen-rich stream (e.g., it could be a nitrogen product with an oxygen level of only a few parts per million (ppm)).

According to the present invention, at least a portion of the compressed, purified, and cooled air is introduced to a first of at least three distillation columns. The first distillation column, which contains at least a condenser at its top, produces at least an oxygen-lean stream from or near its top and a first oxygen-enriched liquid from its bottom. A second distillation column, which contains a reboiler in its bottom, has no condenser, receives at least a portion of nitrogen-enriched liquid as a feed to its top, and produces a first nitrogen-rich vapor stream from its top and a second oxygen-enriched liquid from its bottom. A third distillation column, which contains a reboiler in its bottom, has no condenser, receives at least a portion of nitrogen-enriched liquid as a feed to its top, receives at least said second oxygen-enriched liquid as a feed, and produces a second nitrogen-rich vapor from its top and a liquid oxygen-rich stream from its bottom. The liquid oxygen-rich stream from the third distillation column is elevated in pressure and warmed, at least in part, by indirect heat exchange with a pressurized stream having a nitrogen content greater than or equal to that in the feed air, and said pressurized stream is cooled without being subjected to distillation. The second distillation column receives as a feed at least one of (a) a portion of the first oxygen-enriched stream from the first distillation column; or (b) a portion of said cooled pressurized stream. The third distillation column receives as a feed at least one of (a) a portion of the first oxygen-enriched stream from the first distillation column; or (b) a portion of said cooled pressurized stream.

In the preferred mode of operation, the first distillation column is at the highest pressure, the third distillation column is at the lowest pressure, and the second distillation column is at an intermediate pressure between the highest and lowest pressures.

One embodiment of the invention is shown in FIG. 1. This embodiment comprises a first distillation column 130, a second distillation column 164, and a third distillation column 166. The oxygen product is removed from the distillation column system as an oxygen-rich liquid stream 172. Two nitrogen-rich streams are produced from the distillation column system as a first nitrogen-rich vapor stream 194, a vapor from the top of the second distillation column 164, and a second nitrogen-rich vapor stream 182, a vapor from the top of the third distillation column 166.

Air stream 100 is compressed in a main air compressor 102 and purified in unit 104 to remove impurities such as carbon dioxide and water thereby forming a compressed and purified air feed 106 for the process. The pressure of the compressed air is generally between 75 psia and 250 psia and preferably between 100 psia and 200 psia. Stream 106 is split into two portions, stream 108 and stream 114. Stream 108 is cooled in a main heat exchanger 110 to form cooled air stream 112, which subsequently is introduced to the bottom of the first distillation column 130. Stream 114, which is typically 25% to 30% of the incoming air, is further compressed in a booster compressor 115 to form a pressurized stream 116. Stream 116 is cooled in the main heat exchanger 110 to form stream 118. Stream 118 is eventually reduced in pressure across valve 121 to form stream 122, which constitutes a feed to the third distillation column 166.

The first distillation column 130 produces an oxygen-lean fraction from the top, vapor stream 132, and a first oxygen-enriched liquid stream 168 from the bottom. Stream 132 is split into two portions, stream 134 and stream 140. Stream 134 is condensed in reboiler-condenser 135 to form stream 136; stream 140 is condensed in reboiler-condenser 141 to form stream 142. In this embodiment, stream 136 and stream 142 are combined to form stream 144. A portion of stream 144 is returned to the first distillation column 130 as reflux stream 145. The other portion of stream 144 constitutes nitrogen-enriched liquid stream 150, which eventually is split into stream 152 and stream 156. Stream 152 is reduced in pressure across valve 153 to form stream 154, which constitutes a feed to the top of the second distillation column 164. Stream 156 is reduced in pressure across valve 157 to form stream 158, which constitutes a feed to the top of the third distillation column 166.

First oxygen-enriched liquid stream 168, which has an oxygen content of approximately 35 to 40 mole %, is eventually reduced in pressure across valve 169 to form stream 170, which constitutes a feed to the second distillation column 164. The second distillation column 164 produces a first nitrogen-rich vapor stream 194 from the top and a second oxygen-enriched liquid stream 160 from the bottom. Upward vapor flow for distillation is provided by reboiler-condenser 141. First nitrogen-rich vapor stream 194 is eventually warmed in the main heat exchanger 110 to form stream 196.

Second oxygen-enriched liquid stream 160 has an oxygen content of approximately 50 to 80 mole % and more preferably about 55 to 70 mole %. Stream 160 is eventually reduced in pressure across valve 161 to form stream 162, which constitutes a feed to the third distillation column 166. The third distillation column 166 produces second nitrogen-rich vapor stream 182 from the top and liquid oxygen-rich stream 172 from the bottom. Upward vapor flow for distillation is provided by reboiler-condenser 135. Second nitrogen-rich vapor stream 182 is eventually warmed to intermediate temperature in the main heat exchanger 110. A portion of partially warmed stream 182 is removed at an intermediate temperature as stream 184; the remainder is completely warmed to form stream 192. Stream 184 is reduced in pressure across turbo-expander 185 to form stream 186 and thereby produce refrigeration for the process. Stream 186 is then fully warmed in the main heat exchanger to form stream 188.

Liquid oxygen-rich stream 172 is elevated in pressure through pump 173 to form stream 174. Stream 174 is warmed in the main heat exchanger 110 to form stream 176. At least a portion of the energy needed to warm stream 174 is provided, through indirect heat exchange, by cooling pressurized stream 116. The warming of oxygen-rich stream 174 may include vaporization, and cooling of pressurized stream 116 may include condensation. Pressurized stream 116 is cooled without being subjected to distillation.

A tabulation of representative temperatures, pressures and flows for selected streams in FIG. 1 is provided in Table 1 below.

The term "eventually" when applied to streams such as streams 118, 150,160, 168, 182, and 184 is intended to signify that optional steps may be included. For example, 5 streams 118, 150,160, and 168 may be further cooled before being reduced in pressure, and streams 182 and 194 may be warmed before being introduced to the main heat exchanger 110. Such cooling and warming often is performed in a subcooler (not shown), procedures commonly known in the field of cryogenics. For clarity, the optional use of single or multiple subcoolers is implied but not described.

A noteworthy feature of the embodiment shown in FIG. 1 is that all of the first oxygen-enriched liquid stream 168 is eventually introduced to the second distillation column 164, and all of the cooled pressurized stream 118 is eventually introduced to the third distillation column 166. Alternatively, all of the first oxygen-enriched liquid stream 168 may be eventually introduced to the third distillation column 166, and all of the cooled pressurized stream 118 may eventually be introduced to the second distillation column 164. It has been discovered that efficient operation requires that at least a portion of one of streams 118 or 168 be introduced to the second distillation column and that at least a portion of one of streams 118 or 168 be introduced to the third distillation column.

Figure 2:
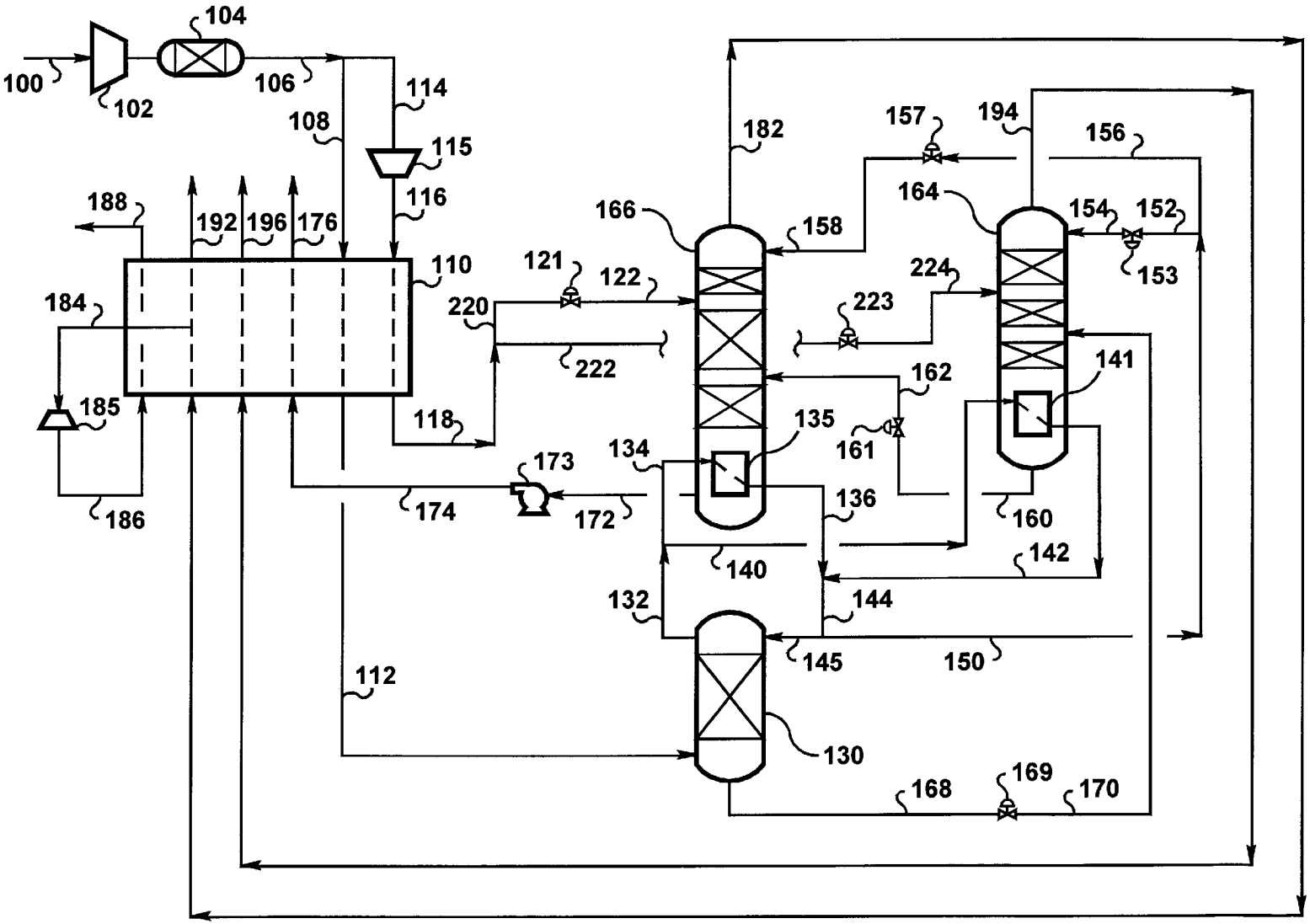
FIG. 2 is a schematic diagram of a second embodiment of the present invention.

FIG. 2 Illustrates another embodiment of the invention. This second embodiment shares many similarities with the embodiment of FIG. 1. Streams in FIG. 2 which are common with those of FIG. 1 are denoted with the same stream numbers and, for clarity, are not described in the discussion below regarding the embodiment shown in FIG. 2.

As shown in FIG. 2, a cooled pressurized stream 118 is divided into stream 220 and stream 222. Stream 222 is eventually reduced in pressure across valve 223 to form 25 stream 224, which constitutes a feed to the second distillation column 164. Stream 220 is eventually reduced in pressure across valve 121 to form stream 122, which constitutes a feed to the third distillation column 166. This embodiment produces some improvement in efficiency by increasing the production of the first nitrogen-rich vapor stream 194 at the expense of decreasing the production of the second nitrogen-rich vapor stream 182. In the more typical cases, when the pressure of the second distillation column is greater than the pressure of the third distillation column, nitrogen product compression power may be reduced.

As an alternative, all of the cooled pressurized stream 118 may eventually be introduced to the second distillation column 164 and first oxygen-enriched liquid stream 168 may eventually be split into two fractions, with one fraction forming a feed to the second distillation column 164 and the other fraction forming a feed to the third distillation column 166. As a further alternative, both stream 118 and stream 168 may be split and eventually be introduced to both the second distillation column and the third distillation column.

Figure 3:
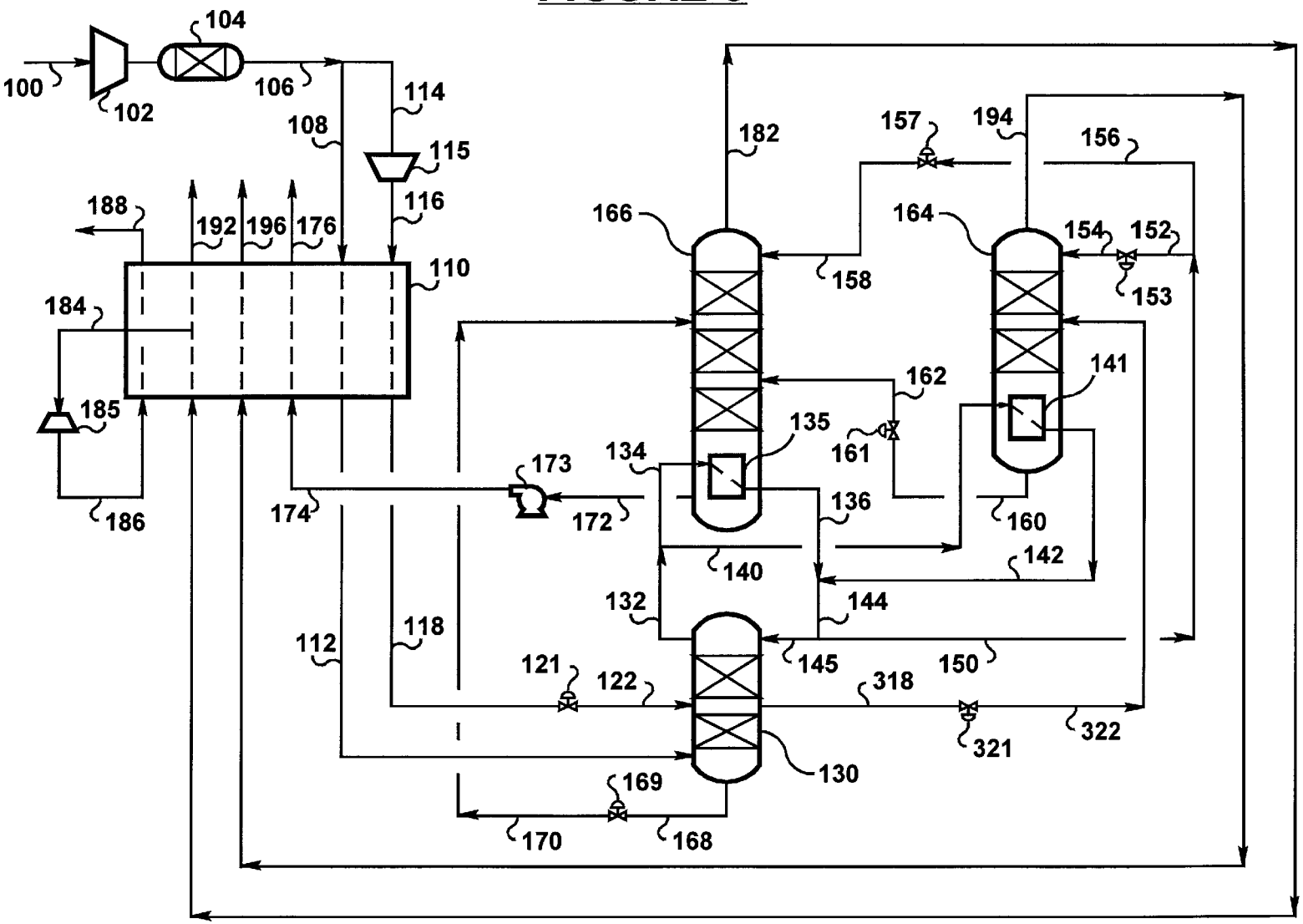
FIG. 3 is a schematic diagram of a third embodiment of the present invention.

FIG. 3 shows an embodiment of the invention which illustrates an alternative processing step for the cooled pressurized stream 118. This embodiment shares many similarities with the embodiment of FIG. 1. Streams in FIG. 3 which are common with those of FIG. 1 are denoted with the same stream numbers and, for clarity, are not described in the discussion below regarding the embodiment shown in FIG. 3.

As shown in FIG. 3, cooled pressurized stream 118 is eventually reduced in pressure across valve 121 to form stream 122. In this embodiment, stream 122 is first introduced as a feed to the first distillation column 130. Liquid stream 318 is withdrawn from an intermediate location of the first distillation column and is eventually reduced in pressure across valve 321 to from stream 322, which constitutes a feed to the second distillation column 164. In this embodiment, first oxygen-enriched liquid stream 168 is withdraw from the bottom of the first distillation column 130 and is eventually reduced in pressure across valve 169 to form stream 170, which constitutes a feed to the third distillation column 166. As an alternative, stream 322 may be a feed to the second distillation column and stream 170 may be a feed to the third distillation column. As a further alternative, either or both of streams 168 and 318 may be split between both the second and third distillation columns.

Introducing the cooled pressurized stream 118 into the first distillation column 130 and then removing a quantity of liquid from an intermediate location, such as stream 318, is a common technique in cryogenic air separation. This is done for simplicity of design as well as for improving efficiency, since some vapor may be present in stream 122 as it enters the distillation column system. Persons skilled in the art will recognize that the flow of stream 318 need not be the same as the flow of stream 122; in fact, the flow of stream 318 is often approximately 50–75% of the flow of stream 122. Persons skilled in the art also will recognize that stream 318 need not be removed from first column 130 from the same location as stream 122 is introduced.

As an alternative, stream 122 may be split into fractions outside the first distillation column 130. In such an event, different fractions may be directed to any or all of the first, second or third distillation columns.

Figure 4:
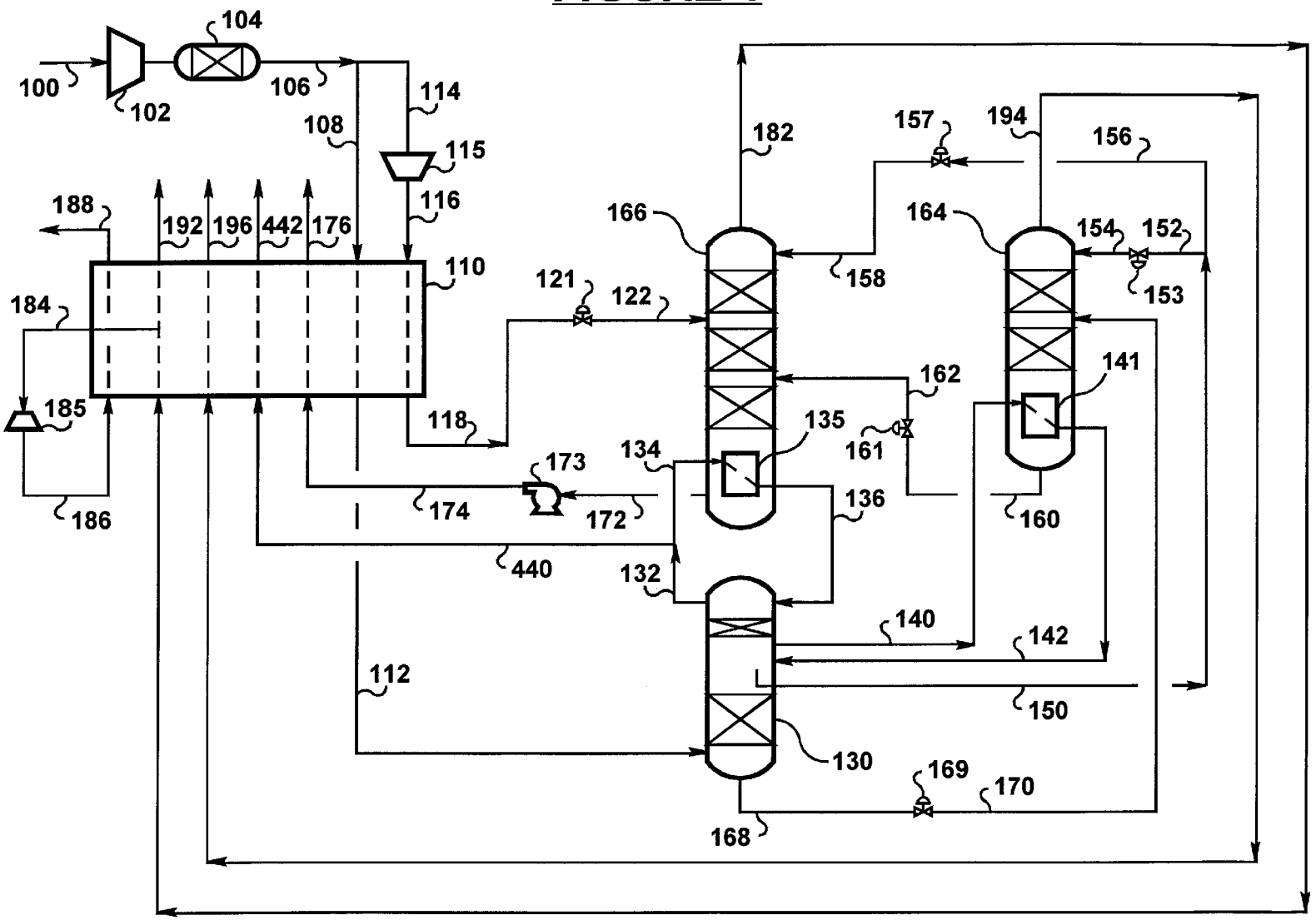
FIG. 4 is a schematic diagram of a fourth embodiment of the present invention.

FIG. 4 illustrates how an additional nitrogen product may be recovered. This embodiment shares many similarities with the embodiment of FIG. 1. Streams in FIG. 4 which are common with those of FIG. 1 are denoted with the same stream numbers and, for clarity, are not described in the discussion below regarding the embodiment shown in FIG. 4.

As shown in FIG. 4, reboiler-condenser 135 and reboiler-condenser 141 condense different oxygen-lean vapors. Vapor stream 132 exits the top of the first distillation column 130 and is split into stream 440 and stream 134. Stream 134 is condensed in reboiler-condenser 135 to form stream 136, which is returned to the first distillation column as top reflux. Stream 440 is warmed in the main heat exchanger 110 to form nitrogen product stream 442.

Vapor stream 140 is removed from an intermediate location of the first distillation column 130, condensed in reboiler-condenser 141 to form stream 142, and returned to the first distillation column as intermediate reflux. Nitrogen-enriched liquid stream 150 is removed from the first distillation column at a location at or near the location that intermediate reflux stream 142 enters the first distillation column.

This embodiment in FIG. 4 is useful when it is desired to produce a high purity nitrogen product from the distillation column system. In this embodiment, such a high purity nitrogen product is represented by stream 440. Typical purity requirement for such a stream may be as low as 1 parts per million (ppm), which is usually much more stringent than the purity requirement for the major nitrogen products such as streams 182 and 194.

In such cases, it is advantageous to withdraw the nitrogen-enriched liquid stream 150 from a location near, but not at, the top of the first distillation column 130. This embodiment also shows that high purity nitrogen stream 440 leaves the first distillation column as a vapor. Alternatively, stream 440 may be removed as a liquid, for example as a portion of stream 136, then pumped to delivery pressure before being warmed in the main heat exchanger 110.

A modification of the embodiment illustrated in FIG. 4 would be to exchange the reboiler-condenser duties. For example, stream 134 could be condensed in reboiler-condenser 141 and stream 140 could be condensed in reboiler-condenser 135.

Figure 5:
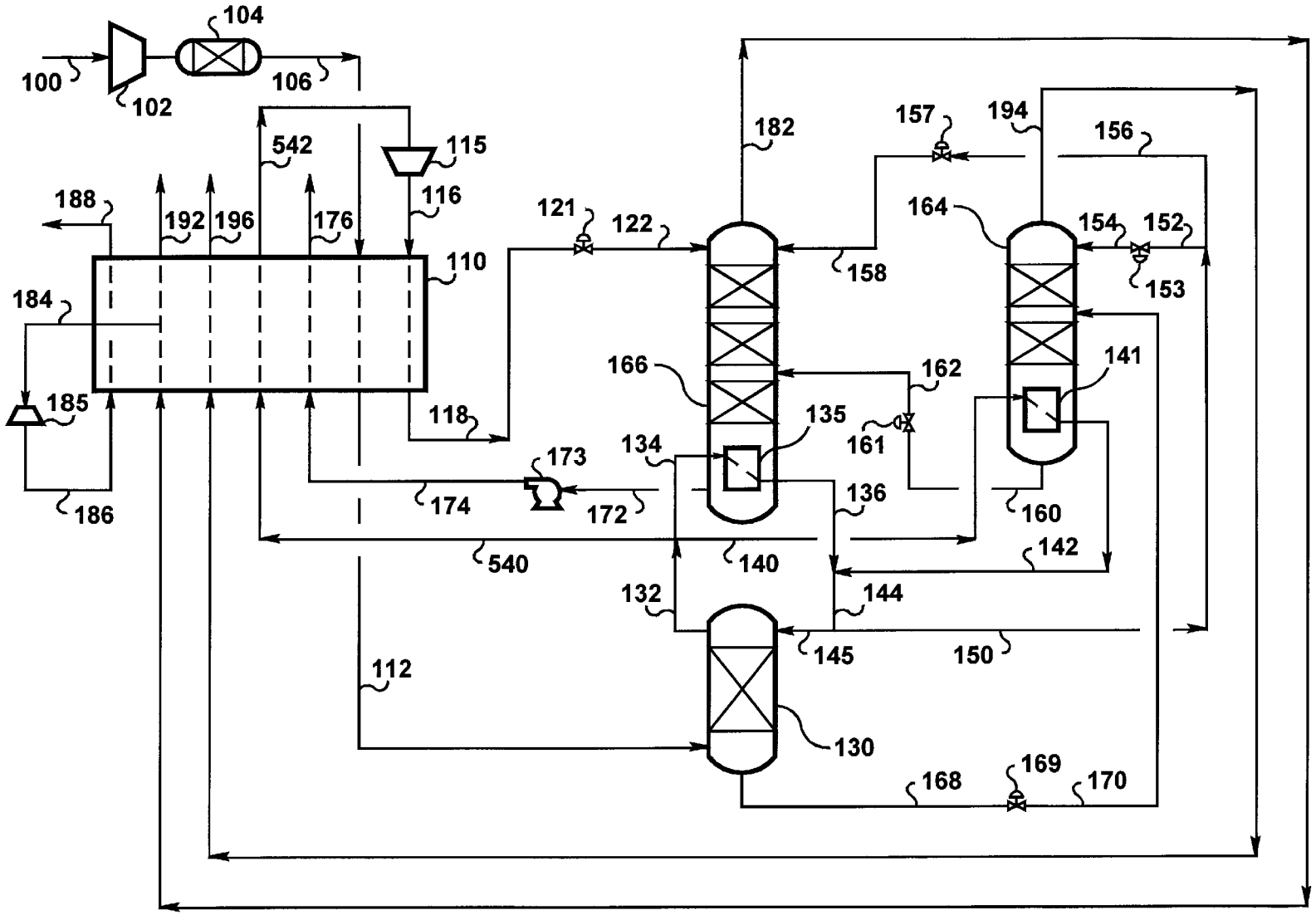
FIG. 5 is a schematic diagram of a fifth embodiment of the present invention.

FIG. 5 illustrates an embodiment which uses an alternative pressurized stream. This embodiment shares many similarities with the embodiment of FIG. 1. Streams in FIG. 5 which are common with those of FIG. 1 are denoted with the same stream numbers and, for clarity, are not described in the discussion below regarding the embodiment shown in FIG. 5.

As shown in FIG. 5, oxygen-lean vapor stream 132 from the first distillation column 130 is split into recycle stream 540 in addition to streams 134 and 140. Recycle stream 540 is warmed to near ambient temperature to form stream 542, compressed in booster compressor 115 to form stream 116, then cooled in the main heat exchanger 110 to form cooled pressurized stream 11 8. Stream 118 is eventually reduced in pressure across valve 121 to form stream 122, which in this case is a second feed to the top of the third distillation column 166.

The embodiment of FIG. 5 may be attractive to employ when booster compressor 115 can be incorporated into other compression services. This is often the case since nitrogen-rich product streams 192 and 196 are typically compressed before being delivered to an end user. Since the composition of stream 542 is nominally the same as streams 192 and 196, compression of stream 542 may be performed in the same compressor.

There are numerous modifications and alternatives to the embodiment shown in FIG. 5, including but not limited to: 1) recycle stream 540 may originate from a location below the top of the first distillation column 130; 2) recycle stream 540 may originate from at, or below, the top of either the second distillation column 164 or the third distillation column 166; 3) the recycle stream may be derived from any of streams 188, 192 or 196; and 4) cooled pressurized stream 118 may be introduced to any or all of the first, second, or third distillation columns.

As another alternative, one may combine elements of the embodiment of FIG. 1 with the embodiment of FIG. 5. In this case, two pressurized streams might be cooled to warm the oxygen-rich stream: one derived from further compression of feed air, and one derived from a recycle from the process such as described in FIG. 5.

Figure 6:
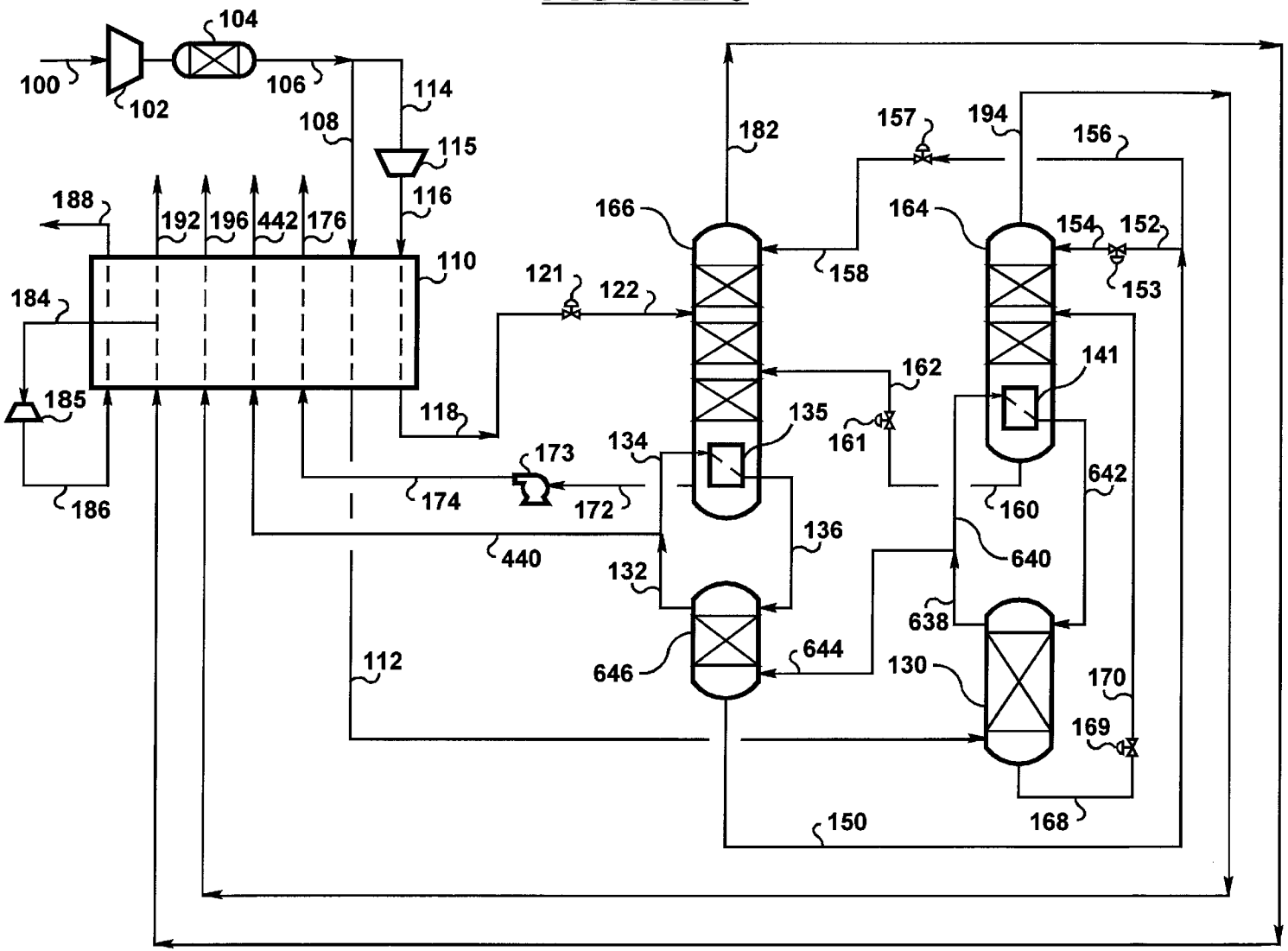
FIG. 6 is a schematic diagram of a sixth embodiment of the present invention.

FIG. 6 is another embodiment of the invention, which shows the use of a fourth distillation column 646. This embodiment shares many similarities with the embodiment of FIG. 1. Streams in FIG. 6 which are common with those of FIG. 1 are denoted with the same stream numbers and, for clarity, are not described in the discussion below regarding the embodiment shown in FIG. 6.

As shown in FIG. 6, oxygen-lean vapor stream 638 from first distillation column 130 is split into streams 640 and 644. Stream 640 is condensed in reboiler-condenser 141 to form stream 642, which is returned to the first distillation column as top reflux.

Stream 644 is introduced to the bottom of the fourth distillation column 646. Fourth distillation column 646 produces a further oxygen-lean fraction from the top, stream 132, and the nitrogen-enriched liquid stream 150 from the bottom. Stream 132 is split into two portions, stream 134 and stream 440. Stream 440 is warmed in the main heat exchanger 110 to form stream 442. Stream 134 is condensed in reboiler-condenser 135 to form stream 136. In this embodiment, the entirety of stream 136 is returned to the fourth distillation column as reflux. Stream 150 is eventually split into stream 152 and stream 156. Stream 152 is reduced in pressure across valve 153 to form stream 154, which constitutes a feed to the top of the second distillation column 164. Stream 156 is reduced in pressure across valve 157 to form stream 158, which constitutes a feed to the top of the third distillation column 166.

This embodiment is useful when it is desired to produce a high purity nitrogen product from the distillation column system. In this embodiment, such a high purity nitrogen product is represented by stream 440. Typical purity requirement for such a stream may be as low as 1 ppm, which is usually much more stringent than the purity requirement for the major nitrogen products such as streams 182 and 194. In such cases, it is advantageous to withdraw the nitrogen-enriched reflux stream 150 from the bottom of the fourth distillation column 646.

This embodiment also shows that high purity nitrogen stream 440 is extracted from the distillation system as a vapor. Alternatively, stream 440 may be removed as a liquid, for example as a portion of stream 136, then pumped to delivery pressure before being warmed in the main heat exchanger 110.

A modification of the embodiment illustrated in FIG. 6 would be to exchange the reboiler-condenser duties. For example, stream 134 could be condensed in reboiler-condenser 141 and stream 640 could be condensed in reboiler-condenser 135.

Figure 7:
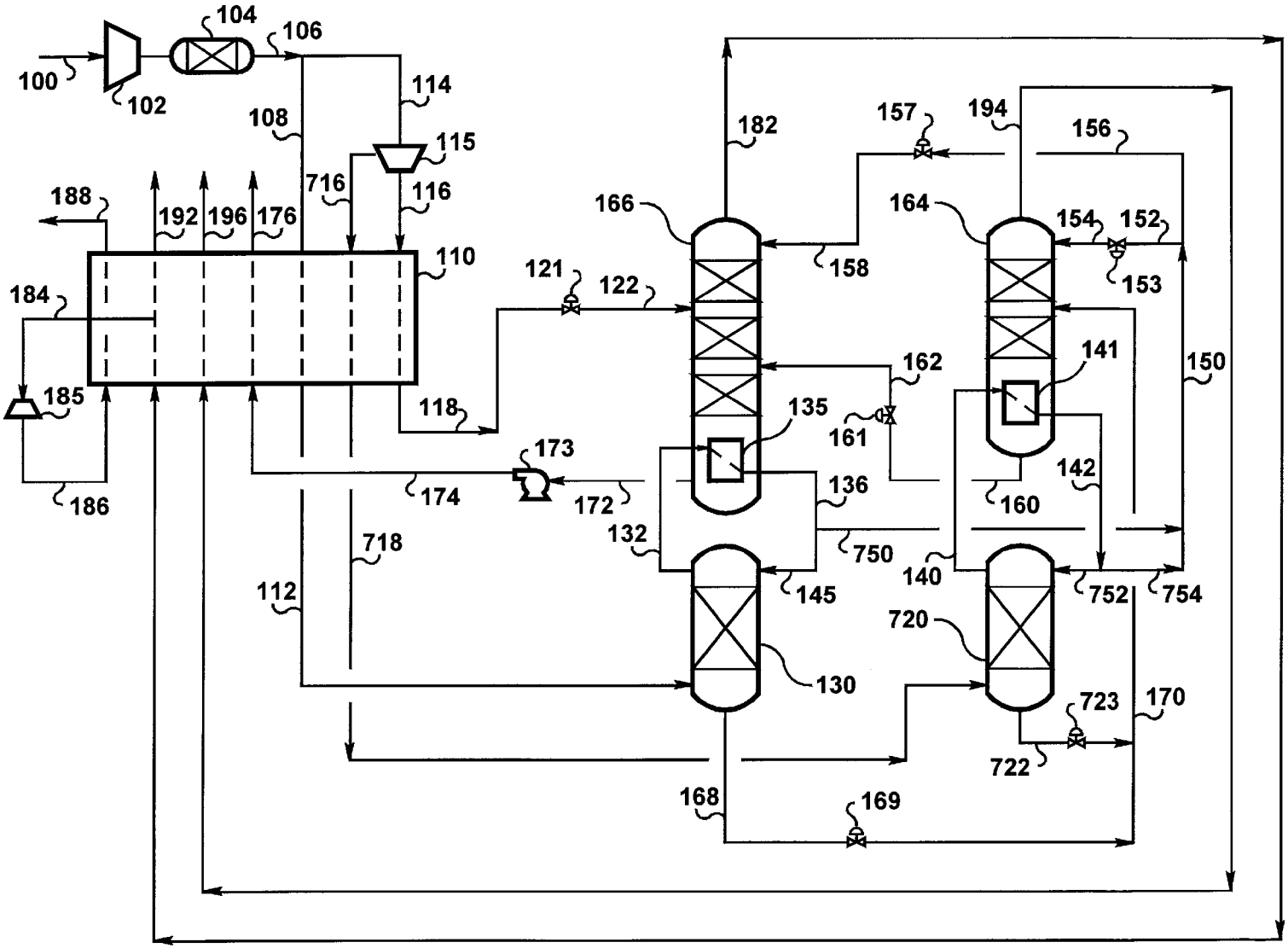
FIG. 7 is a schematic diagram of a seventh embodiment of the present invention.

FIG. 7 is another embodiment of the invention which shows an alternative use of a fourth distillation column 720. This embodiment shares many similarities with the embodiment of FIG. 1. Streams in FIG. 7 which are common with those of FIG. 1 are denoted with the same stream numbers and, for clarity, are not described in the discussion below regarding the embodiment shown in FIG. 7.

As shown in FIG. 7, a third portion of feed air is withdrawn from booster compressor 115 as side stream 716. Stream 716 is cooled in the main heat exchanger 110 to form stream 718, which is the feed to the bottom of the fourth distillation column 720.

First distillation column 130 produces a first oxygen-lean fraction from the top, vapor stream 132, and a first oxygen-enriched liquid stream 168 from the bottom. Stream 132 is condensed in reboiler-condenser 135 to form stream 136. In this embodiment, a portion of stream 136 is returned to the first distillation column 130 as reflux stream 145. The other portion of stream 136 constitutes a first nitrogen-enriched liquid stream 750.

Fourth distillation column 720 produces a second oxygen-lean fraction from the top, stream 140, and a fourth oxygen-enriched liquid stream 722 from the bottom. Stream 140 is condensed in reboiler-condenser 141 to form stream 142. In this embodiment, a portion of stream 142 is returned to the fourth distillation column 720 as reflux stream 752. The other portion of stream 142 constitutes a second nitrogen-enriched liquid stream 754.

In this embodiment, streams 750 and 754 are eventually combined to form a third nitrogen-enriched liquid stream 150, and streams 168 and 722 are eventually combined to form stream 170.

This embodiment is useful for adjusting the relative pressures of the nitrogen-rich streams produced from the second and third distillation columns.

There are numerous modifications and alternatives of the embodiment shown in FIG. 7. For example, as illustrated, the pressure of the fourth distillation column 720 is greater than the pressure of the first distillation column 130. As an alternative, the pressure of the fourth distillation column 720 may be less than the pressure of first distillation column 130. In such a case: 1) air feed 716 could be at a lower pressure than air feed 108; or 2) stream 718 could be derived by turbo-expanding a portion of air feed 108, thereby providing refrigeration for the process and eliminating turbo-expander 185.

Another modification of the embodiment illustrated in FIG. 7 would be to exchange the reboiler-condenser duties. For example, stream 132 could be condensed in reboiler-condenser 141 and stream 140 could be condensed in reboiler-condenser 135.

Persons skilled in the art will recognize that the two air feed streams 108 and 716 may be derived from different sources. For example, each of these two streams may be compressed and purified in separate unit operations. Such an operation would be appropriate when the oxygen production rate is so large as to make using two smaller compressors and/or purifiers economical. Furthermore, separate main heat exchangers could be used. Taken to the extreme, pairs of columns could be operated as separate processes. For example, referring to FIG. 7, the first distillation column 130 and the third distillation column 166 may be built as one plant, complete with a dedicated compressor, purifier, and main heat exchanger; the fourth distillation column 720 and the second distillation column 164 may be built as another plant, complete with a dedicated compressor, purifier, and main heat exchanger. In this alternative, the second oxygen-enriched stream 160 would be transferred from one plant to the other. Numerous additional alternatives can be derived and will be known to persons skilled in the art.

Figure 8:
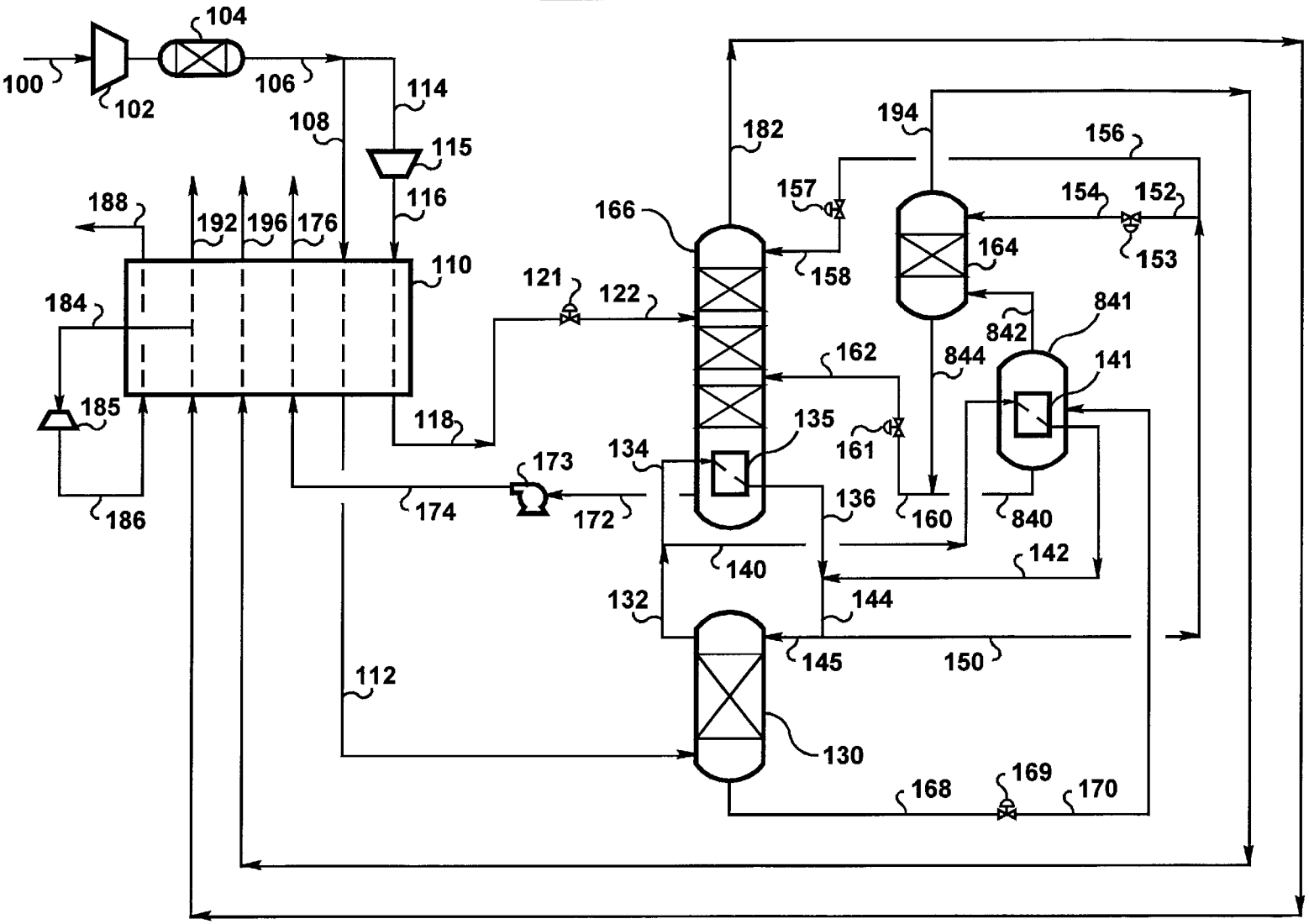
FIG. 8 is a schematic diagram of an eighth embodiment of the present invention.

FIG. 8 is another embodiment of the invention which illustrates that first oxygen-enriched liquid stream 168 may be preprocessed outside either the second distillation column 164 or the third distillation column 166. This embodiment shares many similarities with the embodiment of FIG. 1. Streams in FIG. 8 which are common with those of FIG. 1 are denoted with the same stream numbers and, for clarity, are not described in the discussion below regarding the embodiment shown in FIG. 8.

As shown in FIG. 8, the first oxygen-enriched stream 168 is eventually reduced in pressure across valve 169 to form stream 170. Stream 170 is introduced to a vessel 841 which encloses reboiler-condenser 141. Stream 170 is at least partially vaporized by the reboiler-condenser 141 to produce vapor stream 842 and liquid stream 840. Vapor stream 842 is introduced to the bottom of the second distillation column 164. The bottom liquid from the second distillation column, stream 844, is combined with liquid stream 840 to form second oxygen-enriched stream 160.

The mode of operation suggested by FIG. 8 is essentially equivalent to operating the process of FIG. 1 with the bottom section removed from the second distillation column 164 of FIG. 1. It is therefore within the spirit of the present invention to equate vaporizing a liquid feed outside a column and transferring the vapor to the column with transferring the liquid to the column and vaporizing within the column.

Persons familiar with distillation will understand that it is also possible to pass streams 844 and 840 separately to the third distillation column 166. It also will be understood that a fraction of stream 170 may be split, prior to being introduced to vessel 841, and sent directly to either the second distillation column 164 or the third distillation column 166. Finally, the use of vessel 841 is illustrative and it is known in the field of heat transfer that stream 170 may be sent directly to reboiler-condenser 141.

In FIGS. 1 to 8 the mode of refrigeration supply is through expansion of stream 184 in turbo-expander 185. Other alternatives exist and are known in the field of cryogenic air separation, including but are not limited to: 1) turbo-expansion of a portion of the nitrogen-rich vapor from the second distillation column; 2) turbo-expansion of a portion of pressurized stream 116 to either of the first, second or third distillation columns; 3) turbo-expansion of a portion of incoming air stream 108 to either of the second or third distillation columns; and 4) turbo-expansion of a vapor stream taken from either of the first, second, or third distillation columns, said vapor stream being withdrawn from any location in said columns.

As illustrated in FIG. 1, pressurized stream 118 is shown as being eventually reduced in pressure across a valve 121. It will be known to persons familiar with cryogenics that valve 121 may be replaced with a work producing device, such as a dense fluid expander.

In FIGS. 1 to 8 only one oxygen product is produced. It will be known to persons skilled in the art that multiple oxygen products may be produced. These oxygen products may differ in their pressure and/or purity. Examples of ways to make multiple purity oxygen products include, but are not limited to: 1) withdraw the lower purity oxygen product from a location above the bottom of the third distillation column and withdraw the higher purity oxygen product from the bottom of the third distillation column; and 2) withdraw the lower purity oxygen product from the bottom of the second distillation column and withdraw the higher purity oxygen product from the bottom of the third distillation column.

In FIGS. 3 and 6 it is shown that an additional nitrogen-rich product is made from the first distillation column 130. Persons skilled in the art will recognize that an additional nitrogen-rich product may be made from the first distillation column in any of the embodiments of the present invention. Persons skilled in the art also will recognize that none of the nitrogen-rich products need be the same composition. For example, it is found that in some cases it is advantageous to produce stream 196 and 192 at different purities, so that when combined, they meet the specification of the process. Conversely, all the nitrogen products may be of similar purity and compressed in a common product compressor.

In FIGS. 1 to 8 the main heat exchanger 110 is shown as a single heat exchanger. Persons skilled in the art will recognize that such a depiction is not limiting to the invention. Typically, large plants require multiple heat exchangers in parallel. Furthermore, one may elect to pass different streams to different parallel heat exchangers. One common example, with reference to FIG. 1, would be to pass oxygen-rich stream 174, pressurized stream 116, and a portion of either stream 192 or stream 196 to a first parallel heat exchanger and to pass the remaining streams to a second parallel heat exchanger.

Finally, persons skilled in the art will recognize that one need not recover both streams 192 and 196 as products. For example, referring to the embodiment of FIG. 1, if the quantity of nitrogen desired is not large, one may elect to operate the third distillation column 166 at a reduced pressure and pass all of partially warmed stream 182 to turbo-expander 185. The resultant flow of stream 192 would thereby become zero. In this case, the only nitrogen product produced by the process would be stream 196, along with any optionally produced nitrogen-rich product from the first distillation column 130. In another example, the third distillation column may be operated at near atmospheric pressure and the second nitrogen-rich vapor stream 182 may constitute a waste byproduct rather than a nitrogen product. In such a case, an alternative means of provided refrigeration, such as those previously discussed, would be applied.

In the application of the embodiment of FIGS. 1 to 5 it is possible to spatially locate the three columns in a number of different ways. For example, if minimization of plot size is key, the three columns may be stacked on top of one another. In such a case, six combinations are possible. One configuration of note would be to install the second distillation column 164 on top of the third distillation column 166 and to install the third distillation column on top of the first distillation column 130. This particular configuration is advantageous because stream 160, the second oxygen-enriched stream from the second distillation column, may easily flow downward to the third distillation column.

Alternatively, if minimization of equipment height is key, all three columns may be located along side one another. In such a case, such as in FIG. 1, a pump would be needed to transfer liquid reflux stream 145 to the top of the first distillation column 130. In some circumstances it may be advantageous to locate one of the reboiler-condensers on top of the first distillation column. In such an event a pump would be needed to transfer liquid from the bottom of one or both of the second distillation column 164 and/or third distillation column 166.

An intermediate configuration strategy could install one of the columns on top of the other and have the remaining column located along side. There are six possible combinations of this type. One configuration of note would be to install the third distillation column 166 on top of the first distillation column 130 and to install the second distillation column 164 along side the first distillation column. In principle, any liquid made in reboiler-condenser 141 of the second distillation column would need to be pumped if it was necessary to return liquid to the top of the first distillation column. In the practice of this invention, it is possible to operate in such a manner that the reflux needed for the first distillation column is provided entirely by reboiler-condenser 135 of the third distillation column and it would not be necessary to pump reflux from reboiler condenser 141. Analogously, a configuration may call for installing the second distillation column on top of the first distillation column and installing the third distillation column along side the first distillation column. This configuration is most appropriate when reboiler-condenser 141 of the second distillation column provides all the necessary reflux to the top of the first distillation column.

For the case where the second distillation column 164 and the third distillation column 166 are stacked on one another with the first distillation column 130 installed along side, the preferred configuration would install the second distillation column on top of the third distillation column. This configuration has two advantages: 1) stream 160 may be freely transferred to the third distillation column; and 2) reboiler-condenser 141 may supply all the reflux to the first distillation column and, if elevated properly, said reflux could be transferred without a pump. As with the case where all columns are located along side one another, in some circumstances it may be advantageous to locate one of the reboiler-condensers on top of the first distillation column. In such an event a pump may or may not be needed to transfer liquid from the bottom of one of the second or third distillation columns.

In the application of the embodiments of FIGS. 6 and 7 it is possible to spatially locate the four columns in even more different ways. Although the number of combinations is relatively large, the combinations are easily enumerated. In one possible arrangement, all four columns are installed along side one another. For the case where three columns are stacked on top of one another and one column is installed along the side, there are 24 possible combinations: six configurations with the first distillation column 130 installed along the side, six configurations with the second distillation column 164 installed along the side, and so on.

For the case where two of the columns are stacked on one another and the other two columns are stacked on one another, and the stacked pairs are installed along side of one another, there are twelve possible combinations. For example, as implied by FIG. 6, the third distillation column 166 may be stacked on top of the fourth distillation column 646 and the second distillation column 164 may be stacked on top of the first distillation column 130.

For the case where all four distillation columns are stacked on top of one another, there are 24 possible combinations. For example, referring to FIG. 6, the second distillation column 164 may be on top of the third distillation column 166 which may be on top of the fourth distillation column 646 which may be on top of the first distillation column 130.

Persons skilled in the art will recognize that a reboiler-condenser associated with a column pair may be physically installed: 1) in the bottom of the column receiving the boilup; 2) in the column receiving the reflux; or 3) external to either column. Thus, the spatial location of a reboiler-condenser is also a variable for construction. For example, referring to FIG. 8, reboiler-condenser 141 is shown to be external to the second distillation column 164. In this case, one may elect to place vessel 841, and its contained reboiler-condenser 141, near or below the second distillation column 164, on near or above the first distillation column 130, or even near or above the third distillation column 166.

In the application of the embodiments illustrated in FIGS. 1 to 8, and those alternatives discussed in the text, the selection of the proper spatial location is a cost optimization exercise. Factors which play a role in selecting the optimal configuration include but are not limited to: 1) individual column diameters and column heights; 2) shipping and installation limitations on maximum height; 3) allowable plot space; 4) avoiding the use of liquid pumps; 5) whether the equipment enclosures are shop-fabricated or field-erected; and 6) the existence of other major equipment items, such as main heat exchanger 110. Although, the number of possible options can be large, they are finite and can be readily identified. Therefore, persons skilled in the art may easily evaluate the cost of each configuration and select the optimal arrangement.

EXAMPLE

In order to demonstrate the efficacy of the present invention and to compare the present invention to more conventional processes, the following example is presented. The basis for comparison follows.

The prior art process is a standard elevated pressure, double-column, pumped-LOX cycle as illustrated in FIG. 9. As shown in FIG. 9, air stream 100 is compressed in a main air compressor 102 and purified in unit 104 to remove impurities such as carbon dioxide and water, thereby forming a compressed and purified air feed stream 106 for the process. Stream 106 is split into two portions, stream 108 and stream 114. Stream 108 is cooled in a main heat exchanger 110 to form cooled air stream 112, which is subsequently introduced to a higher pressure column 130. Stream 114 is further compressed in a booster compressor 115 to form pressurized stream 116. Stream 116 is cooled in the main heat exchanger 110 to form stream 118. Stream 118 is eventually reduced in pressure across valve 121 to form stream 122, which constitutes a feed to a lower pressure column 166.

The higher pressure column 130 produces an oxygen-lean fraction from the top, stream 132, and a first oxygen-enriched liquid stream 168 from the bottom. Stream 132 is condensed in reboiler-condenser 135 to form stream 136. A portion of stream 136 is returned to the higher pressure column 130 as reflux stream 145. The other portion of stream 136 constitutes a nitrogen-enriched liquid stream 150. Stream 150 is eventually reduced in pressure across valve 157 to form stream 158, which constitutes a feed to the top of the lower pressure column 166. First oxygen-enriched liquid stream 168 is eventually reduced in pressure across valve 169 to form stream 170, which constitutes a feed to the lower pressure column 166.

The lower pressure column 166 produces a nitrogen-rich vapor stream 182 from the top and a liquid oxygen-rich stream 172 from the bottom. Upward vapor flow for distillation is provided by reboiler-condenser 135. Nitrogen-rich vapor stream 182 is eventually warmed to an intermediate temperature in the main heat exchanger 110. A portion of partially warmed stream 182 is removed at an intermediate temperature as stream 184; the remainder of stream 182 is completely warmed to form stream 192. Stream 184 is reduced in pressure across a turbo-expander 185 to form stream 186 and thereby produce refrigeration for the process. Stream 186 is then fully warmed in the main heat exchanger to form stream 188.

Liquid oxygen-rich stream 172 is elevated in pressure through pump 173 to form stream 174. Stream 174 is warmed in the main heat exchanger 110 to form stream 176. A portion of the energy needed to warm stream 174 is provided, through indirect heat exchange by cooling pressurized stream 116.

The embodiment of the present invention chosen for comparison with the prior art process corresponds to FIG. 1. The production basis is: 1) Oxygen=4,210 lb mole/hr at >95 mole % and 400 psia; 2) Nitrogen=12,960 lb mole/hr at >99 mole % and 150 psia.

Computer simulations of the two processes were developed. Selected results are presented in Table 1. A summary of the power consumed by the two processes is presented in Table 2. The results show that the present invention saves almost 1,000 kW or nearly 6% of the main air compressor power.

TABLE 1

HEAT AND MATERIAL BALANCE

| | | Prior Art - FIG. 9 | | | Present Invention - FIG. 1 | | |
|---|---|---|---|---|---|---|---|
| | Circuit No. | Flow lb mole/hr | Pressure psia | Temp. ° F. | Flow lb mole/hr | Pressure psia | Temp. ° F. |
| Air Feed | 108 | 13,663 | 116 | 67 | 14,231 | 115 | 67 |
| Air Feed | 116 | 5,628 | 960 | 90 | 5,542 | 980 | 90 |
| 1st Nitrogen | 196 | — | — | — | 6,037 | 58 | 64 |

TABLE 1-continued

HEAT AND MATERIAL BALANCE

| | | Prior Art - FIG. 9 | | | Present Invention - FIG. 1 | | |
|---|---|---|---|---|---|---|---|
| | Circuit No. | Flow lb mole/hr | Pressure psia | Temp. ° F. | Flow lb mole/hr | Pressure psia | Temp. ° F. |
| 2nd Nitrogen | 192 | 12,966 | 33 | 65 | 6,929 | 33 | 64 |
| Waste | 188 | 2,079 | 15 | 65 | 2,591 | 15 | 64 |
| Oxygen | 176 | 4,214 | 400 | 65 | 4,214 | 400 | 64 |
| N2 Reflux | 154 | — | — | — | 3,120 | 60 | −297 |
| N2 Reflux | 158 | 5,963 | 35 | −306 | 3,208 | 35 | −305 |
| O2-enriched | 168 | 7,369 | 113 | −271 | 7,691 | 113 | −271 |
| O2 enriched | 160 | — | — | — | 4,766 | 60 | −287 |

TABLE 2

POWER SUMMARY - kW

| | Prior Art FIG. 9 | Present Invention FIG. 1 |
|---|---|---|
| Main Air Compressor | 17,855 | 18,285 |
| Booster Compressor | 5,195 | 5,196 |
| Nitrogen Compressor | 8,238 | 6,817 |
| Total | 31,288 | 30,298 |

Although illustrated and described herein with reference to certain specific embodiments, the present invention is nevertheless not intended to be limited to the details shown or described. Rather, various modifications may be made in the details within the scope and range of equivalents of the claims and without departing from the spirit of the invention.

SEQUENCE LISTING

Not Applicable.

What is claimed is:

1. A process for separating air to produce oxygen and nitrogen, said process using a distillation column system having at least three distillation columns, including a first distillation column, a second distillation column, and a third distillation column, wherein each distillation column has a top and a bottom, comprising the steps of:

providing a stream of compressed air having a first nitrogen content;

feeding at least a first portion of the stream of compressed air to the first distillation column;

withdrawing a first oxygen-enriched liquid stream from the bottom of the first distillation column and feeding at least a portion of the first oxygen-enriched liquid stream to the second distillation column and/or the third distillation column;

withdrawing a first oxygen-lean vapor stream from or near the top of the first distillation column, feeding at least a first portion of the first oxygen-lean vapor stream to a first reboiler-condenser of the second distillation column or of the third distillation column, and at least partially condensing the at least a first portion of the first oxygen-lean vapor stream, thereby forming a first nitrogen-enriched liquid;

feeding at least a first portion of the first nitrogen-enriched liquid to the top of the first distillation column;

feeding a second nitrogen-enriched liquid and/or at least a second portion of the first nitrogen-enriched liquid to the top of the second distillation column;

withdrawing a second oxygen-enriched liquid stream from the bottom of the second distillation column and feeding the second oxygen-enriched liquid stream to the third distillation column;

withdrawing a first nitrogen-rich vapor stream from the top of the second distillation column;

withdrawing a second nitrogen-rich vapor stream from the top of the third distillation column;

withdrawing a liquid oxygen stream from the bottom of the third distillation column, wherein said liquid oxygen stream is elevated in pressure before being warmed at least in part by indirect heat exchange with a pressurized stream having a nitrogen content at least equal to the first nitrogen content, said pressurized stream being cooled without being subjected to distillation; and feeding at least a portion of the cooled pressurized stream eventually to any or all of the first distillation column, the second distillation column, or the third distillation column.

2. A process as in claim 1, wherein the pressurized stream is the first portion of the stream of compressed air.

3. A process as in claim 1, wherein the pressurized stream is another portion of the stream of compressed air.

4. A process as in claim 3, comprising the further step of compressing further the another portion.

5. A process as in claim 1, wherein the pressurized stream is a compressed portion of an oxygen-lean vapor stream withdrawn from the distillation column system.

6. A process as in claim 1, wherein a boilup for the second distillation column is provided at least in part by indirect heat exchange with the first portion of the first oxygen-lean vapor, and wherein a boilup for the third distillation column is provided at least in part by indirect heat exchange with another portion of the first oxygen-lean vapor.

7. A process as in claim 1, wherein the first distillation column is at a first pressure, the second distillation column is at a second pressure lower than the first pressure, and the third distillation column is at a third pressure lower than the second pressure.

8. A process as in claim 1, comprising the further steps of:

providing a fourth distillation column having a top and a bottom;

feeding a second portion of the first oxygen-lean vapor stream from the first distillation column to the bottom of the fourth distillation column;

withdrawing a third nitrogen-enriched liquid stream from the bottom of the fourth distillation column and feeding at least a portion of the third nitrogen-enriched liquid to the second distillation column and/or the third distillation column;

withdrawing a second oxygen-lean vapor stream from or near the top of the fourth distillation column, feeding at least a first portion of the second oxygen-lean vapor stream to a second reboiler-condenser of the second distillation column or of the third distillation column, at least partially condensing the first portion of the second oxygen-lean vapor stream, thereby forming a fourth nitrogen-enriched liquid, and feeding at least a portion of the fourth nitrogen-enriched liquid to the top of the fourth distillation column; and withdrawing a high purity nitrogen stream from the second oxygen-lean vapor stream or the fourth nitrogen-enriched liquid.

9. A process as in claim 1, comprising the further steps of:

providing a fourth distillation column having a top and a bottom;

feeding another portion of the stream of compressed air to the bottom of the fourth distillation column;

withdrawing a third oxygen-enriched liquid stream from the bottom of the fourth distillation column, and feeding at least a portion of the fourth oxygen-enriched liquid stream to the second distillation column and/or the third distillation column;

withdrawing a second oxygen-lean vapor stream from or near the top of the fourth distillation column, feeding at least a portion of the second oxygen-lean vapor stream to a second reboiler-condenser of the second distillation column or of the third distillation column, and at least partially condensing the second oxygen-lean vapor stream, thereby forming the second nitrogen-enriched liquid; and feeding at least a first portion of the second nitrogen-enriched liquid to the top of the fourth distillation column.

10. A process as in claim 9, wherein the fourth distillation column is at a fourth pressure greater than a first pressure of the first distillation column.

11. A process as in claim 9, wherein the fourth distillation column is at a fourth pressure less than a first pressure of the first distillation column.

12. A process as in claim 8, wherein a boilup for the second distillation column is provided at least in part by indirect heat exchange with the first portion of the first oxygen-lean vapor stream, and wherein a boilup for the third distillation column is provided at least in part by indirect heat exchange with the first portion of the second oxygen-lean vapor stream.

13. A process as in claim 9, wherein a boilup for the third distillation column is provided at least in part by indirect heat exchange with the first portion of the first oxygen-lean vapor stream, and wherein a boilup for the second distillation column is provided at least in part by indirect heat exchange with the second oxygen-lean vapor stream.

14. A process as in claim 1, comprising the further steps of:

withdrawing a vapor stream from the first distillation column at an intermediate location, feeding the vapor stream to a second reboiler-condenser of the second distillation column or of the third distillation column, and at least partially condensing the vapor stream, thereby forming an intermediate reflux stream;

feeding the intermediate reflux stream to the first distillation column at or near the intermediate location; and withdrawing the second nitrogen-enriched liquid from the first distillation column at or near the intermediate location for feeding at least a portion to the top of the second distillation column or the third distillation column.

15. A process as in claim 14, wherein a boilup for the second distillation column is provided at least in part by indirect heat exchange with the vapor stream withdrawn at the intermediate location, and wherein a boilup for the third distillation column is provided at least in part by indirect heat exchange with the first portion of the first oxygen-lean vapor stream.

16. A process as in claim 14, wherein a boilup for the third distillation column is provided at least in part by indirect heat exchange with the vapor stream withdrawn at the intermediate location, and wherein a boilup for the second distillation column is provided at least in part by indirect heat exchange with the first portion of the first oxygen-lean vapor stream.

17. A cryogenic air separation unit using a process as in claim 1.

* * * * *